US007784608B2

(12) United States Patent
Tokarski et al.

(10) Patent No.: US 7,784,608 B2
(45) Date of Patent: Aug. 31, 2010

(54) CONTACT LENS PACKAGES

(75) Inventors: Michael G. Tokarski, Ponte Vedra, FL (US); James Peck, Jacksonville, FL (US); Edward Dzwill, Flemington, NJ (US); George Brock, St. Augustine, FL (US); Roger W. Smith, Grove City, OH (US); Michael D. Schulte, Montgomery, OH (US); Michael Scott Ulrich, Columbus, OH (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 581 days.

(21) Appl. No.: 11/255,144

(22) Filed: Oct. 20, 2005
(Under 37 CFR 1.47)

(65) Prior Publication Data

US 2007/0089998 A1 Apr. 26, 2007

(51) Int. Cl.
*A45C 11/04* (2006.01)

(52) U.S. Cl. ..... 206/5.1; 206/205; 206/207; 422/301; 134/137

(58) Field of Classification Search ..... 206/5.1, 206/6.1, 6, 8, 9, 14, 5, 18, 205, 207; D9/420; 220/4.22; 134/6, 137; 422/102, 301
See application file for complete search history.

(56) References Cited

U.S. PATENT DOCUMENTS

| | | | | | |
|---|---|---|---|---|---|
| 2,343,128 | A | * | 2/1944 | Anderson | 206/9 |
| 2,932,383 | A | * | 4/1960 | Fagan | 206/5 |
| 3,089,500 | A | | 5/1963 | Stalcup | |
| 4,037,866 | A | | 7/1977 | Price | |
| 4,244,466 | A | | 1/1981 | Arnhem | |
| 4,308,947 | A | | 1/1982 | Arnhem | |
| 4,378,126 | A | | 3/1983 | Procenko | |
| 4,387,921 | A | | 6/1983 | Licata | |
| 4,415,076 | A | * | 11/1983 | Campbell | 206/5.1 |
| 4,942,959 | A | * | 7/1990 | Sauber et al. | 206/5.1 |
| 5,246,259 | A | | 9/1993 | Hellenkamp et al. | |
| 5,407,241 | A | | 4/1995 | Harrison | |
| 5,439,572 | A | * | 8/1995 | Pankow | 204/450 |
| 5,538,301 | A | | 7/1996 | Yavitz et al. | |
| 5,558,374 | A | | 9/1996 | Harrison | |
| 5,695,049 | A | | 12/1997 | Bauman | |
| 5,704,468 | A | * | 1/1998 | Lust et al. | 206/5.1 |
| 5,710,302 | A | | 1/1998 | Kunzler | |
| 5,722,536 | A | * | 3/1998 | Pierce et al. | 206/5.1 |
| 5,732,990 | A | | 3/1998 | Yavitz et al. | |
| 5,760,100 | A | | 6/1998 | Nicolson | |
| 5,776,999 | A | | 7/1998 | Nicolson | |
| 5,789,461 | A | | 8/1998 | Nicolson | |

(Continued)

FOREIGN PATENT DOCUMENTS

EP 406161 B 2/1995

(Continued)

OTHER PUBLICATIONS

PCT International Partial Search Report, dated Jan. 15, 2007, for PCT Int'l. Appln. No. PCT/US2006/040406.

*Primary Examiner*—Ehud Gartenberg
*Assistant Examiner*—Andrew Perreault

(57) ABSTRACT

The invention provides contact lens packages in which removal of the lens is facilitated by elevating the lens when the package is opened.

3 Claims, 4 Drawing Sheets

U.S. PATENT DOCUMENTS 5,823,327 A * 10/1998 Wu et al. ..... 206/5.1
5,849,811 A 12/1998 Nicolson
5,891,258 A * 4/1999 Pankow ..... 134/6
5,965,631 A 10/1999 Nicolson
5,998,498 A 12/1999 Vanderlaan
6,087,415 A 7/2000 Vanderlaan
6,365,111 B1 * 4/2002 Bass ..... 422/102
6,401,915 B1 * 6/2002 Faxe ..... 206/5.1
6,471,052 B2 10/2002 Faxe et al.
6,702,348 B1 3/2004 Rigdon
6,739,636 B2 5/2004 Py
2005/0189404 A1 * 9/2005 Xiaohai et al. ..... 229/103.11
2006/0054514 A1 * 3/2006 Tokarski et al. ..... 206/5.1

FOREIGN PATENT DOCUMENTS

GB 841668 A 7/1960
JP 2000016905 B 1/2000
WO 9421698 A 9/1994
WO WO 2005082721 A2 9/2005

* cited by examiner

CONTACT LENS PACKAGES

The invention relates to packages for storing contact lenses. In particular the invention provides a contact lens package that facilitates removal of the lens from the package.

BACKGROUND OF THE INVENTION

Contact lenses have been used to improve vision for many years. Contact lenses originally were made of hard materials, which were relatively easy to handle, but were uncomfortable on-eye for many patients. More recently, softer lenses made of hydrogels, including silicone hydrogels, have been commercialized, which lenses are more comfortable to wear.

Most contact lenses, in particular soft contact lenses, typically are packaged in individual blister packages having a bowl portion and a foil top. The more pliable the lenses, the more problems that are presented to the user in removing the lenses from the package. For example, the soft contact lenses may be difficult to grasp and extract from the package or the lens may fold on itself when extracted.

DETAILED DESCRIPTION OF THE INVENTION

The invention provides contact lens packages, and methods of using and making such packages, that facilitate removal of the lens from the packages. In the packages of the invention, removal of the lens is facilitated by providing a package which elevates the lens when the package is opened. The invention is useful with any type of contact lens, but may find its greatest utility with soft contact lenses.

In one embodiment the invention provides a contact lens package comprising, consisting essentially of, and consisting of a means for elevating a contact lens stored therein.

Typically, soft contact lenses are purchased by the consumer in blister packages. A blister package is a small, bowl-shaped, fluid-filled package the top of which is sealed with a laminated foil top. When the conventional blister package is opened, the lens remains in the bottom of the fluid-filled cavity that typically is bowl-shaped.

Figure 1:
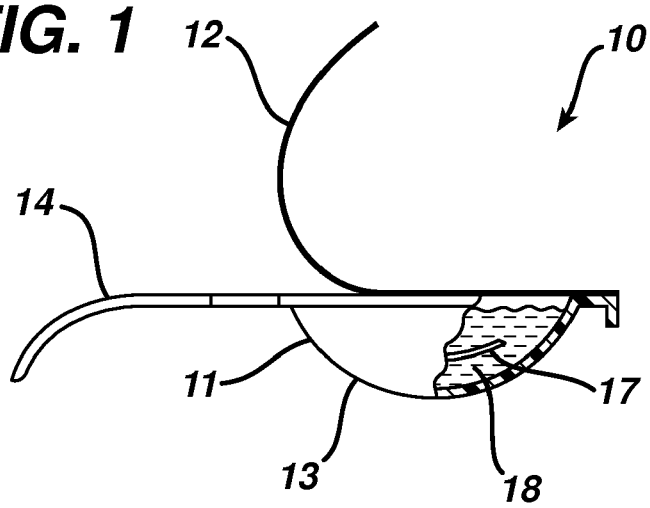
FIG. 1 is a side view of a conventional contact lens package showing a partial cross-section with the cover partially peeled back.

In FIG. 1 is shown a side view of a conventional blister package 10 showing a contact lens 17 and a lens storage solution 18 therein. The package 10 is composed of a base 11, cover 12, and flange 14. Base 11 has a bowl-shaped recess 13 the circumference of which is contiguous with flange 14.

It is a discovery of the invention that removal of the lens from a package can be facilitated by providing a means for elevating the lens when the package is opened. The lens may be elevated any amount of height, but preferably is elevated so that it is above the surface of the lens storage solution within the package. More preferably, the lens is elevated above the top edges of the cavity in which the lens has been packaged.

The elevation means may be any means suitable for elevating the contact lens to the desired height. Thus, the elevating means may be, without limitation, a mechanical deformation of the storage cavity within the package when the package is opened which deformation results in elevation of the lens, a spring, a lever, a sponge, a foam or other means that is activated on opening of the package to elevate the lens and combinations thereof. In the packages of the invention, preferably, the elevating means is a mechanical deformation of the package or a foam that, when wetted on package opening, expands and elevates the lens to the desired height.

Figure 2:
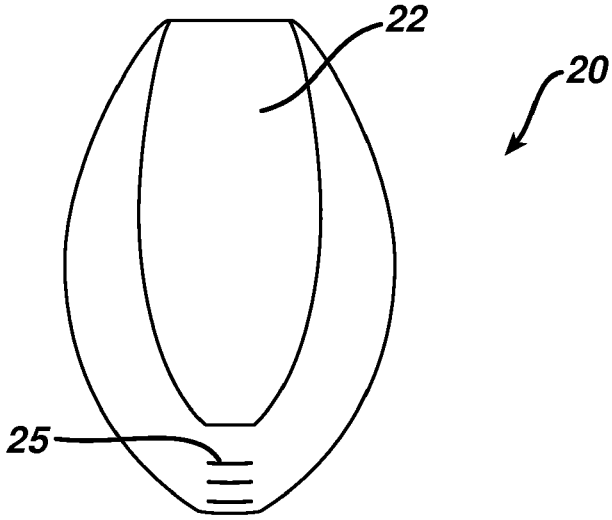
FIG. 2 is a top plan view of one embodiment of a contact lens package of the invention.
Figure 3:
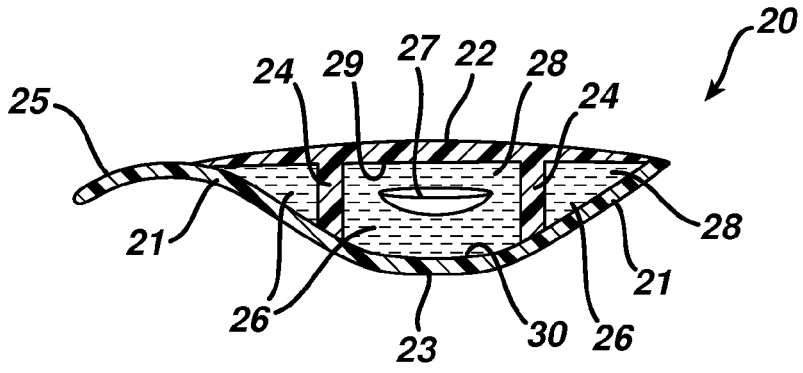
FIG. 3 is a cross-section of the contact lens package of FIG. 2.
Figure 4:
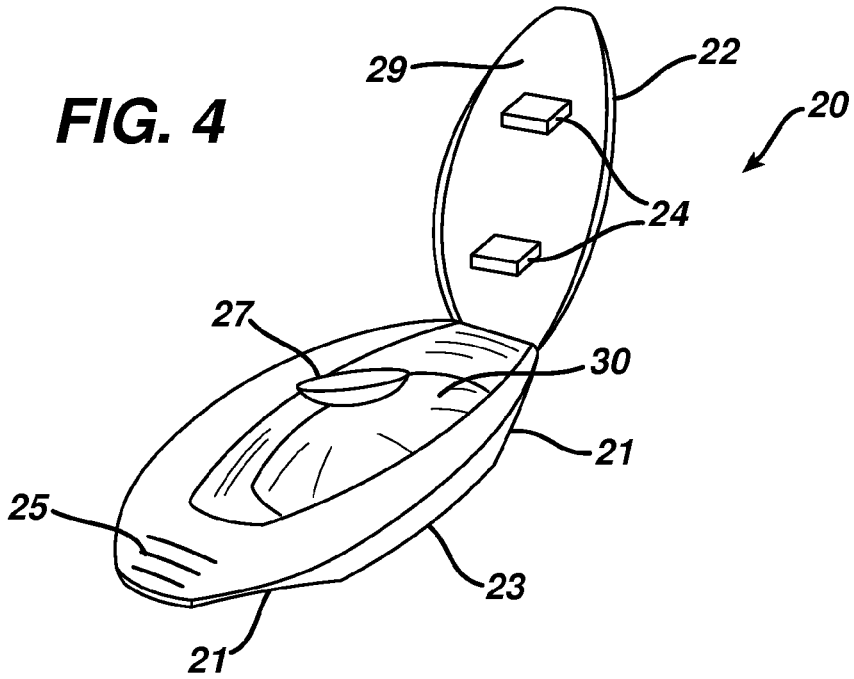
FIG. 4 is a perspective view of the package of FIG. 2.

In FIGS. 2, 3 and 4 are shown a top plan, a cross section, and a perspective view, respectively of a package 20 of the invention. Package 20 has a cover 22. The base of package 20 is composed of sidewalls 21 and bottom 23, within which base is housed lens 27 and solution 28. The circumference of sidewalls 21 are contiguous with a flange 25. Additionally, sidewalls 21 and bottom 23 define a cavity 26 which cavity is segmented into three sections by at least two partitions 24. Partitions 24 are contiguous with and extend downwardly from inner surface 29 of cover 22. When cover 22 is intact and package 20 is sealed, partitions 24 exert a downward pressure on the inner surface 30 of bottom 23. The pressure is sufficient to deform inner surface 30 and bottom 23 so that a depression is formed in inner surface 30, which depression preferably is a substantially concave or bowl-shaped area in which the lens resides when the package is sealed. Partitions 24 are sized and shaped, and formed of a material sufficiently rigid, to exert the desired amount of pressure on bottom 23. Bottom 23 is preferably made of a material that is more flexible than partitions 24 and more preferably is more flexible than partitions 24 and cover 22.

FIG. 4 depicts that, when cover 22 is lifted upwardly, the downward pressure exerted by partitions 24 is relieved allowing inner surface 30 of bottom 23 to assume a convex shape. This serves to raise lens 27 out of cavity 26 for easy removal from the package.

The base and cover of the package may be made from any of a number of materials provided that those materials are compatible with the inspection and sterilization requirements of contact lens manufacture. Examples of suitable materials include but are not limited to polypropylene, polyethylene, nylons, olefin co-polymers, acrylics, rubbers, urethanes, polycarbonates, or fluorocarbons. The preferred materials are metallocenes polymers and co-polymers made of polypropylene, polyethylene, having a melt flow range of about 15 g/10 minutes to about 44 g/10 minutes as determined by ASTM D-1238. The base and cover may be made by any of convenient means and preferably are made by injection molding.

Figure 5:
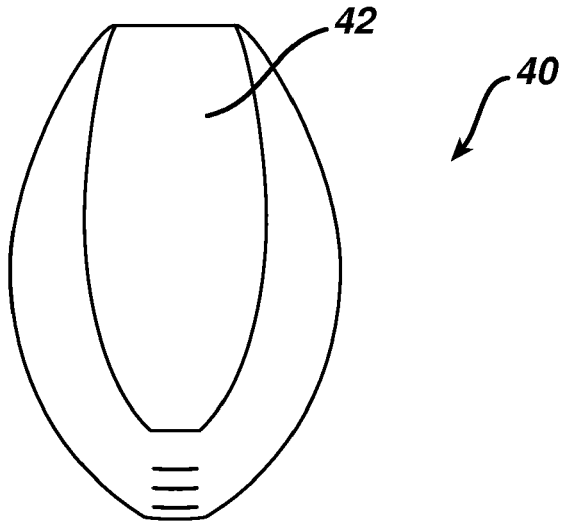
FIG. 5 is a top plan view of a second embodiment of a contact lens package of the invention.
Figure 6:
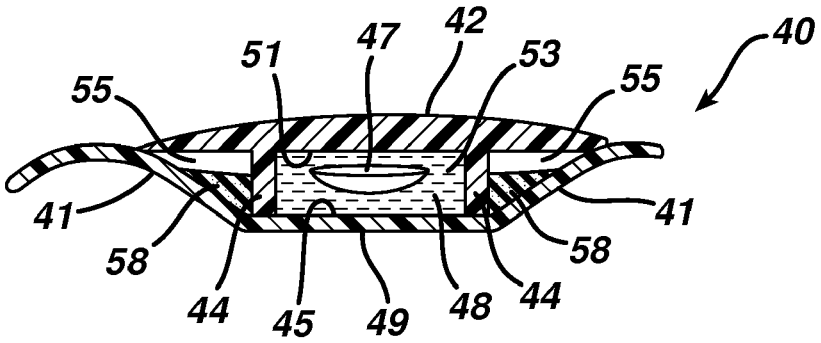
FIG. 6 is a cross-section of the contact lens package of FIG. 5.
Figure 7:
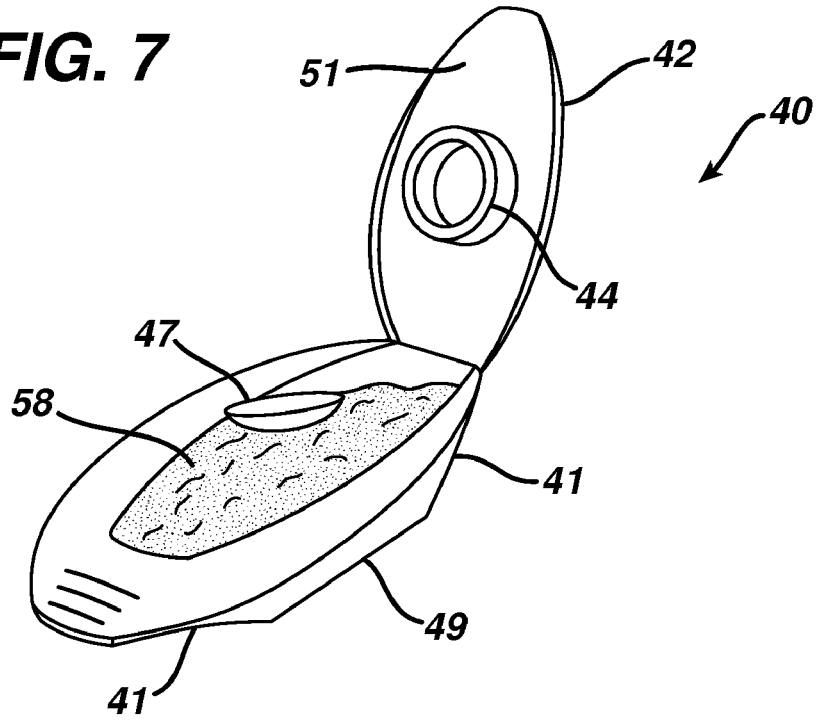
FIG. 7 is a perspective view of the contact lens package of FIG. 5.

In FIGS. 5 through 7 is shown a second embodiment of the invention. Package 40 has a cover 42 and a base composed of sidewalls 41 and bottom 49. Sidewalls 41 and base 49 define a cavity therebetween. Cover 42 has inner surface 51, which inner surface 51 has a ring 44 extending downwardly therefrom. When cover 42 is intact and package 40 is sealed, ring 44 serves to divide the cavity formed by sidewalls 41 and base 49 into an inner cavity 53 and an outer cavity 55. Ring 44 contacts the inner surface 45 of bottom 49 so as to form a water-tight compartment, inner cavity 53, in which lens 47 and storage solution 48 are stored and isolated from foam 58 contained in outer cavity 55. When cover 42 is lifted upwardly, the seal for inner cavity 53 is disrupted and the contents of inner cavity 53 and outer cavity 55 are mixed.

When solution 48 comes into contact with foam 58, foam 58 absorbs the solution and expands upwardly elevating lens 47, as depicted in FIG. 7.

The foam useful in this embodiment may be any foam that is capable of expansion upon wetting with lens storage solution. Additionally, the foam selected must not introduce contaminants into the lens package and must be able to withstand the sterilization process for the contact lens and package. A suitable foam useful in the invention is an open cell polymer foam as for example one made from hydroxylated polyvinyl acetate. One such type of foam is commercially available under the name MEROCEL®. The amount of foam used will depend upon the size of the cavities in the package within which the lens and foam reside. An amount of foam is used that, upon wetting with the storage solution, expands sufficiently so as to elevate the contact lens to a desired height, preferably to elevate the lens above the height of the cavity in which the lens resides.

The materials useful for forming the cover and base of this embodiment of the package are the same as for those of the first embodiment. However, in this package, it is not preferred that the cover or the ring material be made of a higher modulus material than the base.

The packages of the invention preferably are used to store contact lenses made from silicone elastomers or hydrogels, which include but are not limited to silicone hydrogels, and fluorohydrogels. Soft contact lens formulations are disclosed in U.S. Pat. No. 5,710,302, WO 9421698, EP 406161, JP 2000016905, U.S. Pat. No. 5,998,498, U.S. patent application Ser. No. 09/532,943, U.S. Pat. Nos. 6,087,415, 5,760,100, 5,776,999, 5,789,461, 5,849,811, and 5,965,631. The foregoing references are hereby incorporated by reference in their entirety. More preferably, the packages are sued to store soft contact lenses made from etafilcon A, genfilcon A, lenefilcon A, polymacon, acquafilcon A, balafilcon A, lotrafilcon A. and silicone hydrogels as prepared in U.S. Pat. No. 5,998,498, U.S. patent application Ser. No. 09/532,943, a continuation-in-part of U.S. patent application Ser. No. 09/532,943, filed on Aug. 30, 2000, U.S. Pat. Nos. 6,087,415, 5,760,100, 5,776,999, 5,789,461, 5,849,811, and 5,965,631 hereby incorporated by reference in their entirety.

What is claimed is:

1. A contact lens package, comprising:

(a) a cover having an inner surface;

(b) a base and comprising at least two sidewalls and a bottom having an inner surface and wherein the sidewalls and base define a cavity; and (c) a ring extending downwardly from the inner surface of the cover, wherein, when the cover is intact and the package is sealed, the ring divides the cavity into a water-tight, inner cavity suitable for housing a contact lens and a solution and an outer cavity suitable for housing a foam capable of expansion upon wetting with lens storage solution;

wherein when the cover is lifted upwardly, the contents of the inner cavity mix with the contents of the outer cavity so that the lens is upwardly elevated.

2. The package of claim 1, wherein the foam is an open cell polymer foam.

3. The package of claim 1, wherein the foam is a hydroxylated polyvinyl acetate foam.

* * * * *